US008096416B2

(12) United States Patent
de Pagter et al.

(10) Patent No.: US 8,096,416 B2
(45) Date of Patent: Jan. 17, 2012

(54) FLOWER SUPPORT WITH STEM PROTECTION

(75) Inventors: Janus Adriaan Willem de Pagter, Dinteloord (NL); Simon Eduard Niekolaas, Schipluiden (NL); Eleonora Patricia van den Putten, Essen (BE)

(73) Assignee: Pagter & Partners International B.V. (NL)

( * ) Notice: Subject to any disclaimer, the term of this patent is extended or adjusted under 35 U.S.C. 154(b) by 910 days.

(21) Appl. No.: 11/885,657

(22) PCT Filed: Mar. 3, 2006

(86) PCT No.: PCT/NL2006/050043

§ 371 (c)(1),
(2), (4) Date: May 21, 2008

(87) PCT Pub. No.: WO2006/093409

PCT Pub. Date: Sep. 8, 2006

(65) Prior Publication Data

US 2009/0049744 A1 Feb. 26, 2009

(30) Foreign Application Priority Data

Mar. 3, 2005 (NL) ..... 1028452

(51) Int. Cl.
*B65D 85/50* (2006.01)

(52) U.S. Cl. ..... 206/423; 47/41.01; 248/27.8

(58) Field of Classification Search ..... 47/41.01, 47/41.11, 41.12, 41.13, 41.14, 41.15, 44, 47/45, 47; 206/423; 248/27.8
See application file for complete search history.

(56) References Cited

U.S. PATENT DOCUMENTS

| | | | | |
|---|---|---|---|---|
| 1,893,970 | A | 1/1933 | Takahashi | |
| 3,044,200 | A * | 7/1962 | Teufel | 428/27 |
| 6,752,270 | B1 | 6/2004 | Helsloot et al. | |
| 2002/0014427 | A1 * | 2/2002 | van der Stoep et al. | 206/423 |
| 2003/0074835 | A1 | 4/2003 | De Pagter et al. | |

FOREIGN PATENT DOCUMENTS

| | | | |
|---|---|---|---|
| EP | 0022319 | A1 | 1/1981 |
| EP | 0395827 | A1 | 11/1990 |
| EP | 1306319 | A2 | 5/2003 |
| NL | 1004335 | C1 | 4/1998 |
| NL | 1012164 | C2 | 11/2000 |
| NL | 1015844 | C2 | 2/2002 |
| NL | 1019223 | C2 | 5/2003 |

* cited by examiner

*Primary Examiner* — Tien Dinh
*Assistant Examiner* — Michael Kreiner
(74) *Attorney, Agent, or Firm* — The Webb Law Firm

(57) ABSTRACT

A flower support for long-stemmed flowers comprises an elongated support part as well as series of hook means in which the flower stems can be hooked, which series of hook means at both sides of the support part extend away from each other in an obliquely oriented fashion. The series of hook means are positioned obliquely with respect to each other. The oblique position of the series of hook means brings that a cavity is formed in which the stems of the hooked in flowers are well protected.

12 Claims, 6 Drawing Sheets

FLOWER SUPPORT WITH STEM PROTECTION

BACKGROUND OF THE INVENTION

1. Field of the Invention

The invention is related to a flower support for long-stemmed flowers, comprising an elongated support part as well as series of hook means in which the flower stems can be hooked, which series of hook means extend away from each other in an obliquely oriented fashion at both sides of the support part.

2. Description of Related Art

A flower support of this kind is disclosed in NL-C-1015844. Said prior art flower support has been shaped as a flat sheet, two opposite longitudinal edges of which are provided with slots in which respectively a long stemmed-flower such as a gerbera and the like can be hooked. The flower support with the hooked in flowers should be subsequently accommodated in a container, such as a box, which is then completed for storage and transport.

The disadvantage of this prior art flower support is related to the fact that the stems of the hooked in flowers can not be protected well against undesirable loadings. In this connection, the stems are in danger of being flattened in the box, which has a very adverse effect on the quality of the product as delivered. Furthermore, the flower support has not been shaped in accordance with the shape of the flower head, which means that said flower head is not protected adequately.

SUMMARY OF THE INVENTION

The object of the invention is to provide a flower support of the type mentioned before by means of each the flowers can be protected better. Said object is achieved in that the series of hook means are positioned obliquely with respect to each other.

The oblique position of the series of hook means with respect to each other results in a space being formed in which the stems of the hooked in flowers are well protected. The series ensure that the flowers, in particular the stems thereof, are not subjected to pressure or other loadings. Possible pressure forces are accommodated through the series of hook means.

In particular, a cavity may be provided which extends along the support part, said cavity being suitable for receiving the flower stem of an introduced flower. In this connection the support part may comprise two surfaces which extend with respect to each other at an angle, the cavity being defined between said surfaces.

The series of hook means may each comprise flower stem introduction slots which open out into respective reception apertures, wherein said flower stem introduction slots are defined between wings which are positioned at a distance from each other in the lengthwise direction of the support part and which extend each time from a longitudinal side of the support part. With regard to a better support of the flower, a bowl-shaped recess may be provided in the surface surrounding the reception aperture for receiving the bottom side of the flower. Also the flower stem introduction slot may open out in two or more of such reception openings. A further advantage of such slots is that the flower support can be withdrawn relatively simple from the hooked in flowers, as a result of which all these flowers can be freed in one movement.

With respect to transport in upright condition, the lower end of the support part can be provided with a foot. In that case, the wings are directed away from the foot and upwardly in an oblique fashion.

According to a further embodiment, coupling means may be provided for coupling two flower supports in such a way that the series of hook means of the flower supports which are coupled to each other are facing each other. These coupling means can be located at both ends of the support part.

According to a first variant, the support part and the hook means may be carried out as a unity of for instance sheet shaped or plate shaped material such as cardboard. In the cavity, formed in the cardboard at the location of the support part, the stems of the hooked in flowers can be stored in a well protected fashion.

According to a second embodiment the support part may comprise two rods which are mutually connected and are located next to each other, each rod carrying a series of hooks. Here as well the stems are relatively well protected by the obliquely oriented series of hooks, which surround the stems on both sides as it were.

BRIEF DESCRIPTION OF THE DRAWINGS

The invention will now be explained further with reference to some embodiments shown in the drawings.

DETAILED DESCRIPTION OF THE INVENTION

Figure 1:
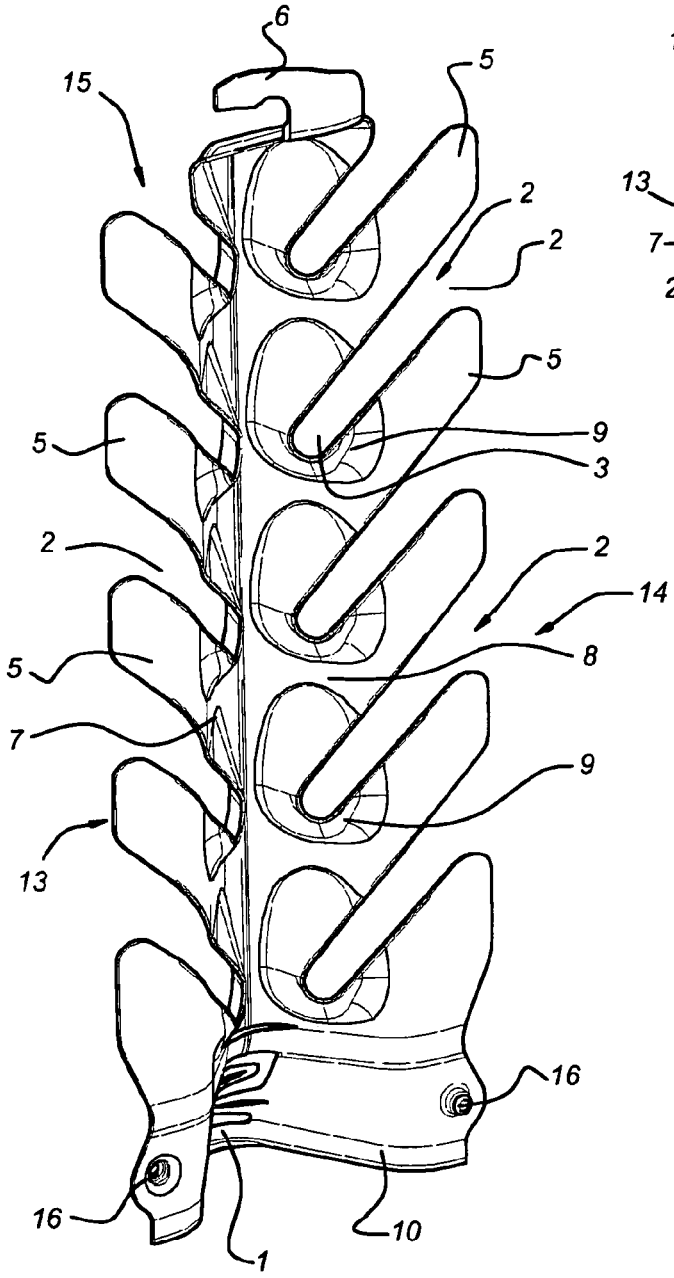
FIG. 1 shows a first embodiment of the flower support according to the invention.

The first embodiment of a flower support shown in FIG. 1 according to the invention comprises an elongated support part 1, onto which the hook means, generally indicated with 2, are provided. These hook means 2 comprise flower stem introduction slots 2 which are defined between each time two wings 5. These flower stem introduction slots 2 each have a reception opening 3 in which the upper part of a stem, for instance of a gerbera, can be fitted. The flower head can then be accommodated in the bowl-shaped recess 9 which has been provided around the reception opening 3. At the lower side of the support part, a foot 10 has been provided. At the upper side of the support part a hook 6 has been provided, by means of which the flower supports can be hung.

Figure 2:
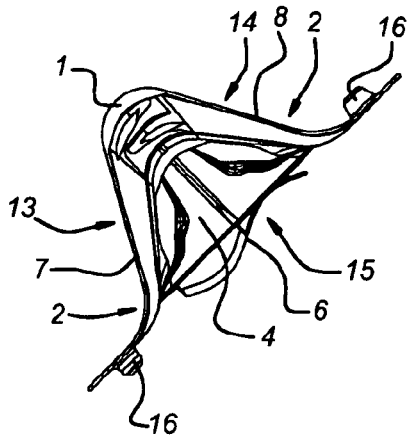
FIG. 2 shows a top view of the support according to FIG. 1.

As shown in the top view of FIG. 2, the series 13, 14 of hook means 2, which are at both sides of the support part 1, run obliquely with respect to which other. Between the series, thus a cavity 4 is formed, in which the stems of the hooked in flowers can be safely accommodated. In the top view of FIG. 2 it can be seen that coupling means 16 are provided in the vicinity of the foot 10, by means of which each time two flower supports can be coupled onto each other. At the top side, the flower supports can be coupled to each other by means of hooking in the hooks 6.

Figure 3:
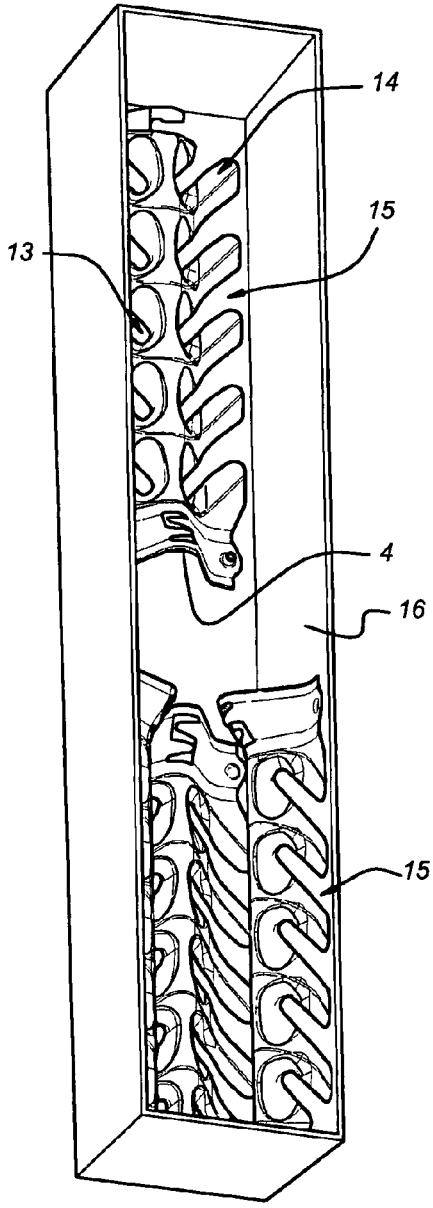
FIG. 3 shows two flower supports, accommodated in a packaging box.
Figure 4:
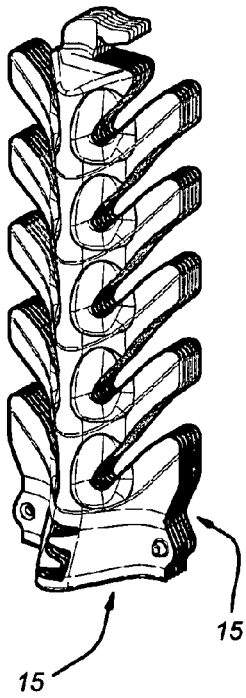
FIG. 4 shows a number of nested flower support.

FIG. 3 shows a number of flower supports 15, which have been accommodated in the box 16. Thanks to the obliquely oriented position with respect to each other of the series of hook means 2, in that case the stems are well protected accommodated in the cavity 4. The series of hook means can be locked in many different ways in the box. FIG. 4 shows that a series of supports 15 can be nested within one another by means of the cavities, in such a way that little room is necessary for transport.

Figure 5:
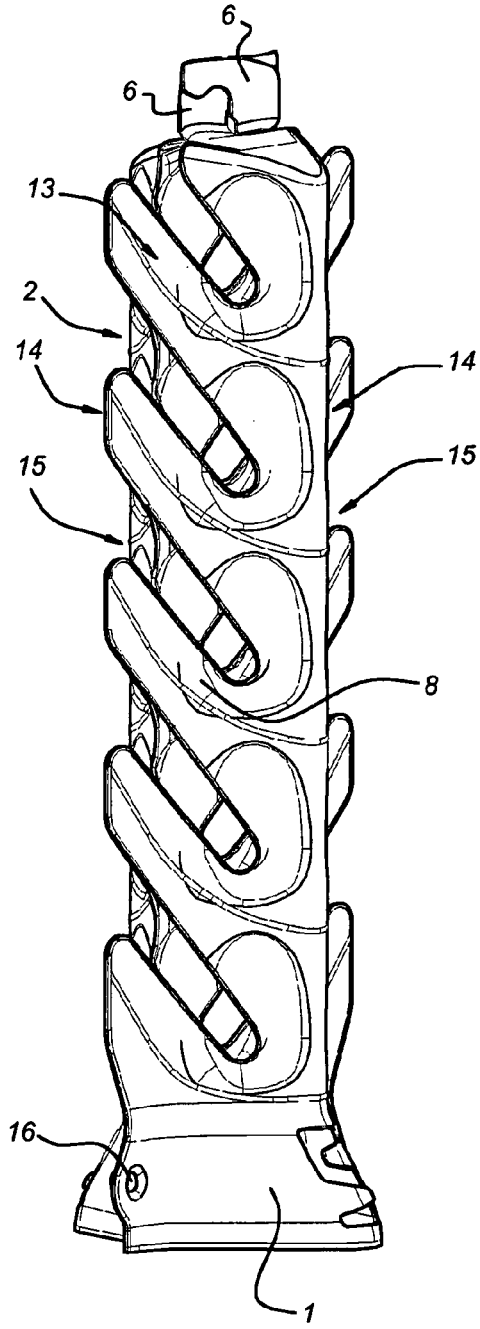
FIG. 5 shows two assembled flower supports.

The embodiment of FIG. 5 shows that each time two flower supports 15 can be positioned in such a way that the series of hooks 13 respectively 14 are placed against each other by means of the hooks 6 and the coupling means of 16. A cavity for the flower stems is thus obtained at the sides of the flower supports 15 which are directed towards one another.

Figure 6:
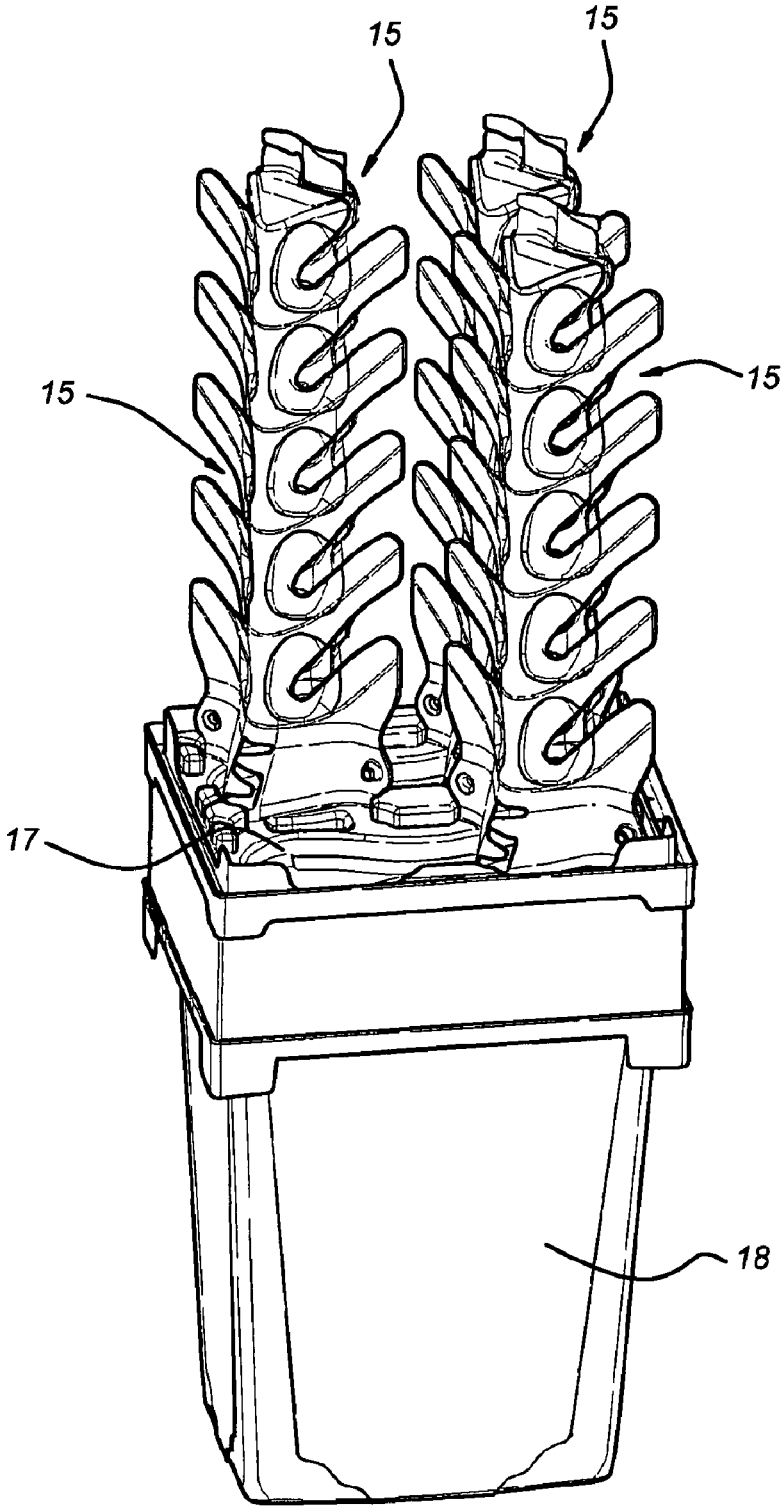
FIG. 6 shows the assembled flower supports according to FIG. 5, accommodated on a water container.

As shown in FIG. 6, more of such pairs of flower supports 15 which are connected to each other can be accommodated upon the support 17 of a water container which has been indicated in full by 18. The stems of the flowers are hanging up to and into the water of the water container 18 through the cavity formed between each time two of such flower supports 15. In this connection it is also possible that layouts are applied as disclosed in NL-C-1012164 and NL-C-1019223.

Figure 7:
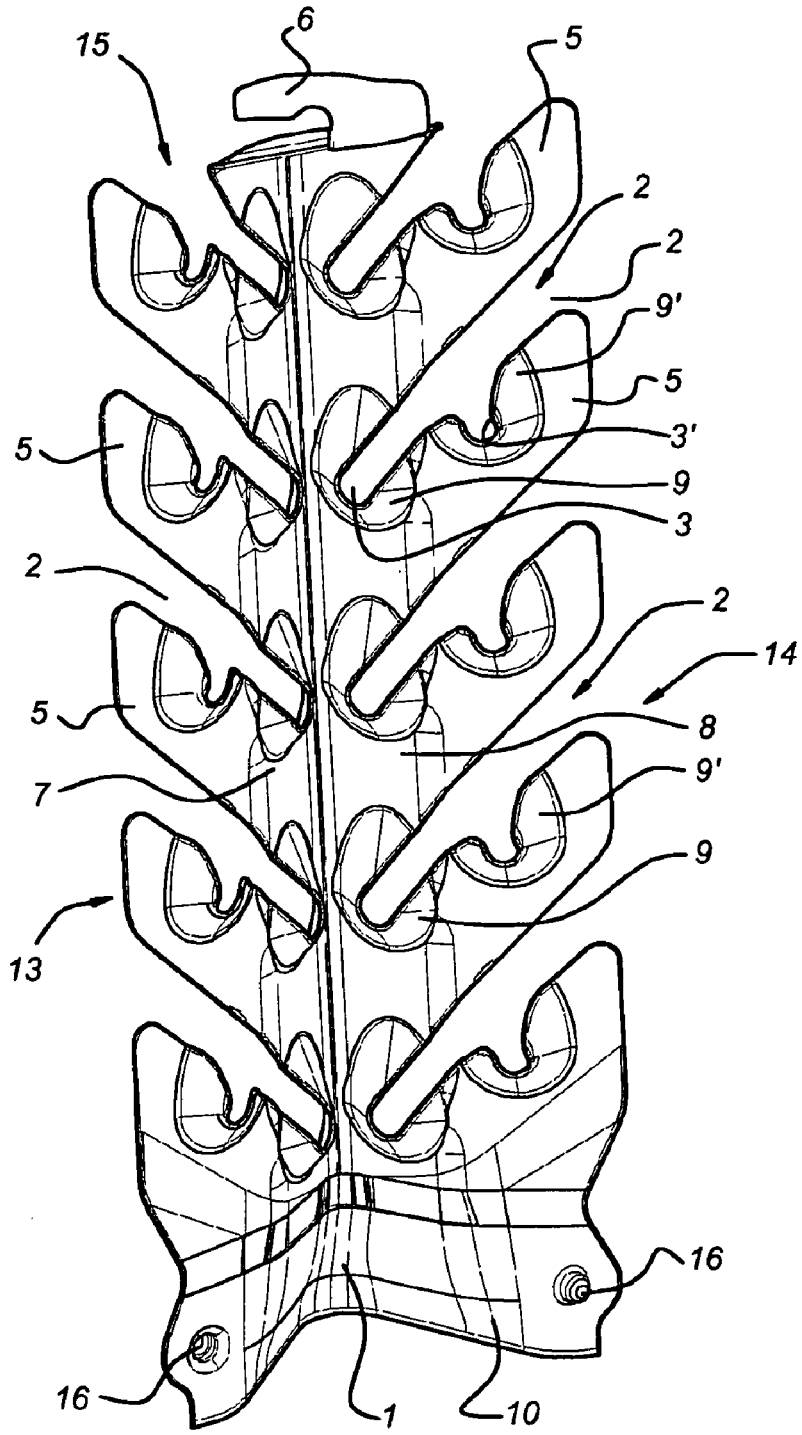
FIG. 7 shows an alternative embodiment of the flower support according to FIG. 1.

In the embodiment of FIG. 7 two reception openings 3, 3' are present in each flower stem introduction slot, each provided with a bowl-shaped recess 9, 9'.

Figure 8:
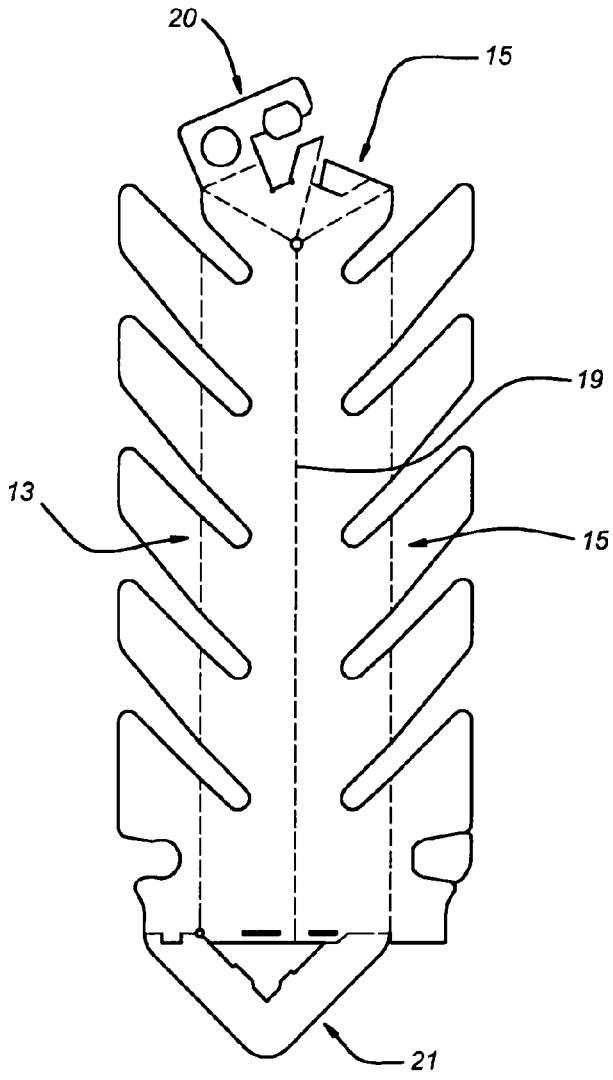
FIG. 8 shows the second embodiment of the flower support.

The embodiment of FIG. 8 shows a flower support 15, in which a fold line 19 is available. By means of the positioning means 20, 22, the two series of hook means 13, 14 are kept positioned obliquely with respect to each other.

Figure 9:
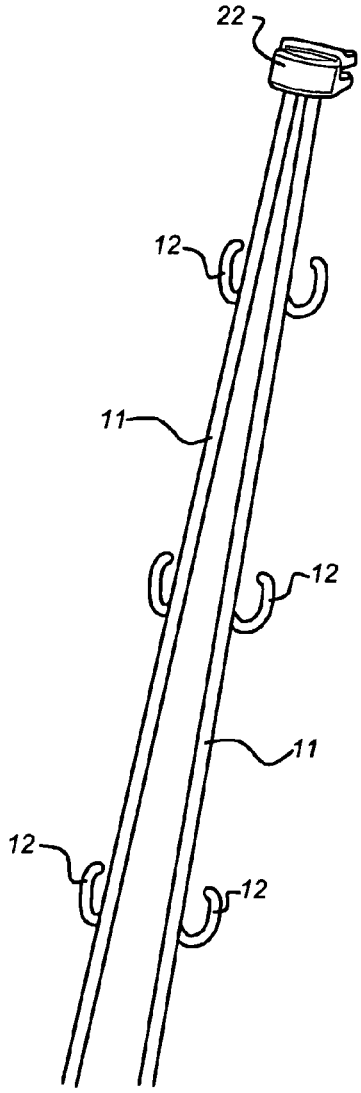
FIG. 9 shows a third embodiment of the flower support.

In the embodiment of FIG. 9, a flower support is shown which comprises two rods 11, which at the top side are mutually connected by means of a connection piece 22. Each rod comprises a series of hooks 12, which in top view are obliquely oriented towards each other.

The invention claimed is:

1. Flower support for long-stemmed flowers, comprising an elongated support part as well as a series of hook means in which the flower stems are capable of being hooked, said series of hook means being at both sides of the elongated support part and positioned obliquely with respect to the longitudinal direction of the elongated support part, characterized in that a cavity has been provided which extends along the support part, said cavity adapted for receiving the flower stem of an introduced flower, and in that the elongated support part comprises two surfaces which that extend with respect to each other at an angle, wherein the cavity is defined between said surfaces.

2. The flower support according to claim 1, wherein each series of hook means comprises flower stem introduction slots that open out into respective reception apertures, wherein the flower stem introduction slots are defined between wings that are positioned at a distance from each other in the lengthwise direction of the support part and which extend from a longitudinal side of the support part.

3. The flower support according to claim 2, further comprising a bowl-shaped recess in each respective surface surrounding the reception aperture for receiving a bottom side of the flower.

4. The flower support according to claim 3, wherein each respective flower stem introduction slot opens out in two or more reception openings.

5. The flower support according to claim 4, further comprising a bowl-shaped recess in each respective surface extending around each reception opening for receiving a flower.

6. The flower support according to claim 2, wherein an end of the support part includes a foot.

7. The flower support according to claim 6, wherein the wings are obliquely directed away from the foot.

8. The flower support according to claim 1, further comprising coupling means for coupling two flower supports such that the series of hook means of the respective flower supports that are coupled to each other are facing each other.

9. The flower support according to claim 8, wherein the coupling means are located at both ends of the support part.

10. The flower support according to claim 1, wherein the support part and the hook means are constructed by a unity of sheet shaped or plate shaped material.

11. The flower support according to claim 10, wherein the material comprises cardboard.

12. The flower support according to claim 1, wherein the support part comprises two rods that are mutually connected and are located next to each other, wherein each rod includes a series of hooks.

* * * * *